US008654161B2

(12) United States Patent
Imaizumi

(10) Patent No.: US 8,654,161 B2
(45) Date of Patent: Feb. 18, 2014

(54) HEAD ELEMENT OPERATION CHECK MECHANISM, HEAD ELEMENT OPERATION CHECK METHOD, AND HEAD ELEMENT NUMBER CHECK METHOD

(75) Inventor: Atsuyuki Imaizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 231 days.

(21) Appl. No.: 13/011,552

(22) Filed: Jan. 21, 2011

(65) Prior Publication Data

US 2011/0181677 A1 Jul. 28, 2011

(30) Foreign Application Priority Data

Jan. 22, 2010 (JP) ..... 2010-012389

(51) Int. Cl.
*B41J 2/00* (2006.01)

(52) U.S. Cl.
USPC ..... 347/192

(58) Field of Classification Search
USPC ..... 347/190–192, 195, 211, 171
See application file for complete search history.

(56) References Cited

U.S. PATENT DOCUMENTS

| | | | |
|---|---|---|---|
| 5,951,175 | A | 9/1999 | Kawamori |
| 2007/0046703 | A1 | 3/2007 | Tamura |

FOREIGN PATENT DOCUMENTS

| | | | |
|---|---|---|---|
| EP | 0982134 | A2 | 3/2000 |
| JP | 64-50944 | | 3/1989 |
| JP | 2-9645 | A | 1/1990 |
| JP | 5-169706 | A | 7/1993 |
| JP | 5-286158 | A | 11/1993 |
| JP | 6-227018 | A | 8/1994 |
| JP | 2000-141730 | A | 5/2000 |
| JP | 2001-180027 | A | 7/2001 |

OTHER PUBLICATIONS

Extended European Search Report issued Sep. 19, 2011 for Application No. 11151695.1.

European Search Report, Apr. 7, 2011.

*Primary Examiner* — Kristal Feggins

(74) *Attorney, Agent, or Firm* — Nutter McClennen & Fish LLP; John J. Penny, Jr.; Christina M. Sperry

(57) ABSTRACT

A head element operation check mechanism in a printer which is provided with a head including a plurality of head elements is provided. A controller controls a selector to selectively and electrically connect a resistor element provided in each of the head elements to a test resistor element in series. A test power source applies a test voltage to a serial circuit of the test resistor element and the resistor element. A divided voltage measuring unit measures a divided voltage of the serial circuit of the test resister element and the resistor element in response to control of the controller.

7 Claims, 6 Drawing Sheets

HEAD ELEMENT OPERATION CHECK MECHANISM, HEAD ELEMENT OPERATION CHECK METHOD, AND HEAD ELEMENT NUMBER CHECK METHOD

The disclosure of Japanese Patent Application No. 2010-012389, filed on Jan. 22, 2010, including specification, drawings and claims are incorporated herein by reference in its entirety.

BACKGROUND

The present invention relates to a head element operation check mechanism, head element operation check method, and head element number check method, in a printer including a head.

JP-A-06-227018, discloses a technique relating to the detection of a defective thermal head element in a thermal printer.

JP-A-06-227018, discloses "a thermal head driving control method comprising the steps of: driving a head element included in a thermal head; detecting whether the head element reaches a preset temperature after a predetermined time elapses; and giving an indication if the head element does not reach the preset temperature after the predetermined time elapses" (claim 1).

Further, JP-A-2000-141730, pages 4-6, and FIG. 1 discloses a method of detecting a defect in a thermal head in a thermal printer.

JP-A-2000-141730, discloses "a method of detecting a defect of a thermal head, which detects variation in resistors of a plurality of head elements included in the thermal head used in a thermal printer, comprising: a first step of checking whether a maximum value and a minimum value of resistance of the plurality of head elements are within a predetermined range at the time of initial setting when the thermal head is exchanged; and a second step of checking whether resistance of each of the plurality of head elements is within the range of the maximum value and the minimum value obtained in the first step" (claim 1).

The techniques disclosed in the JP-A-06-227018, and JP-A-2000-141730, perform measurement by sequentially applying a heater voltage to all head elements. Thus, the head elements are heated (for printing) in the detecting operation.

SUMMARY

It is therefore an object of at least one embodiment of the present invention to provide a head element operation check mechanism which is capable of detecting defective elements of a thermal head in a thermal printer without heating the head elements.

It is another object of at least one embodiments of the present invention to provide a head element operation check method which is capable of simply detecting defective elements of a thermal printer with using the head element operation check mechanism.

It is still another object of at least one embodiments of the present invention to provide a head element number check method which detects the number of the head elements of a thermal head mounted on a thermal printer with using the head element operation check mechanism.

In order to achieve the above-described objects, according to a first aspect of the embodiments of the present invention, there is provided a head element operation check mechanism in a printer which is provided with a head including a plurality of head elements, the head element operation check mechanism comprising: a test resistor element; a controller that controls a selector to selectively and electrically connect a resistor element provided in each of the head elements to the test resistor element in series; a test power source that applies a test voltage to a serial circuit of the test resistor element and the resistor element; and a divided voltage measuring unit that measures a divided voltage of the serial circuit of the test resister element and the resistor element in response to control of the controller.

With this configuration, it is possible to monitor changes in the divided voltage by electrically connecting the resistor element of the head element to the test resistor element in series and applying the test voltage thereto. Thus, it is possible to detect whether the resistor element of the head element is a defective element on the basis of the change in the divided voltage. Further, it is possible to provide the head element operation check mechanism which is capable of detecting defective elements of a thermal head in a thermal printer without heating the head elements by providing a test power source which is different from a driving power source for performing a normal printing process and by setting the test voltage of the test power source to such a degree that the resistor elements are not heated.

Further, in the head element operation check mechanism, the controller may stores a table which indicates relationship between the number of resistor elements electrically connected in series to the test resistor element and the divided voltage and perform an operation check of each of the head elements with reference to the table.

With this configuration, by storing the table in advance, it is possible to find the relationship between the number of the resistor elements to which the test voltage is applied and the divided voltage. For example, in a case where one head element and the test resistor element are electrically connected in series and the test voltage is applied thereto, if the head element is normal, the divided voltage should be lowered. By using the change in the divided voltage, it is possible to check for malfunctions of each head element.

Further, in the head element operation check mechanism, the head elements may be thermal head elements, the resistor element may be a heating element, the selector may include a shift register and a latch circuit, and the test voltage may be lower than a printing voltage of a thermal head.

With this configuration, since the test voltage is lower than the printing voltage of the thermal head, it is possible to check operation of the head element without heating the head element, unlike a normal printing process.

According to a second aspect of the embodiments of the present invention, there is provided a head element operation check method in a printer which is provided with a head including a plurality of head elements, the head element operation check method comprising: controlling a shift register to selectively and electrically connect a register element provided in each of the head elements to a test resistor element in series; applying a test voltage to a serial circuit of the test resistor element and the resistor element; measuring a divided voltage of the serial circuit of the test resister element and the resistor element while applying the test voltage to the serial circuit; and checking for malfunction in each of the head elements on the basis of an output of the shift register and the measured divided voltage.

Simply by adding a test power source and a test resistor element to a configuration of the related-art thermal head and by carrying out each of the above steps, it is possible to automatically detect defective elements of a thermal printer.

According to a third aspect of the embodiments of the present invention, there is provided a head element number check method in a printer which includes a head including a plurality of head elements, a latch circuit and a shift register for inputting printing data corresponding to one line to the head through the latch circuit and performs printing with using the head elements, the head element number check method comprising: inputting element number check data to the shift register as the printing data corresponding to one line; detecting a divided voltage of a serial circuit of a test resistor element and a resistor element provided in each of the head elements while inputting the element number check data to the shift register; and checking the number of the head elements on the basis of a result of the detecting.

With this configuration, it is possible to provide a head element number check method which is capable of detecting the number of head elements of a thermal head mounted on a thermal printer, with using the above-described head element operation check mechanism.

Further, in the head element number check method, it is preferable to apply the head element operation check method in the printer as described above, in place of the result of the detecting.

With such a configuration, it is possible to automatically detect the number of head elements, in addition to detection of a defective element of a thermal printer.

Further, in the head element number check method, the element number check data has a digit number corresponding to the first number of the head elements in a predetermined standard, at least one digit from the first digit thereof being 1, and the other digits thereof being 0.

With this configuration, by using the element number check data having a digit number corresponding to the number of the head elements in the predetermined standard, at least one digit from the first digit thereof being 1, and the other digits thereof being 0, it is possible to detect changes in the divided voltage when the test voltage is applied. If the divided voltage is changed, it is found that the test voltage is applied to the head element to which the data "1" is input. Thus, it is possible to check that the number of head elements is at least equal to or larger than the digit number of the input element number check data corresponding to one line.

The head element number check method may further comprise: if the number of the head elements is not determined in the checking, inputting element number check data which has a digit number corresponding to the second number of the head elements, less than the first number in the predetermined standard, at least one digit from the first digit thereof being 1, and the other digits thereof being 0, to the shift register as the printing data corresponding to one line; and performing the detecting and the checking again. The head element number check method may further comprise repeating the steps of claim 7 while gradually reducing the digit number of the element number check data in conformity with the predetermined standard until the number of the head elements is determined in the checking.

If the divided voltage is not changed, it is possible to confirm that the number of the head elements is less than the digit number of the input element number check data corresponding to one line. Thus, if the divided voltage is not changed, the head element number check method sequentially reduces the digit number of the element number check data and detects the digit number when the divided voltage is changed as the number of the head elements. In this way, with this configuration, it is possible to easily check the number of the head elements.

DETAILED DESCRIPTION OF THE EMBODIMENTS

Hereinafter, a head element operation check mechanism according to an embodiment of the present invention will be described with reference to the accompanying drawings.

Figure 1:
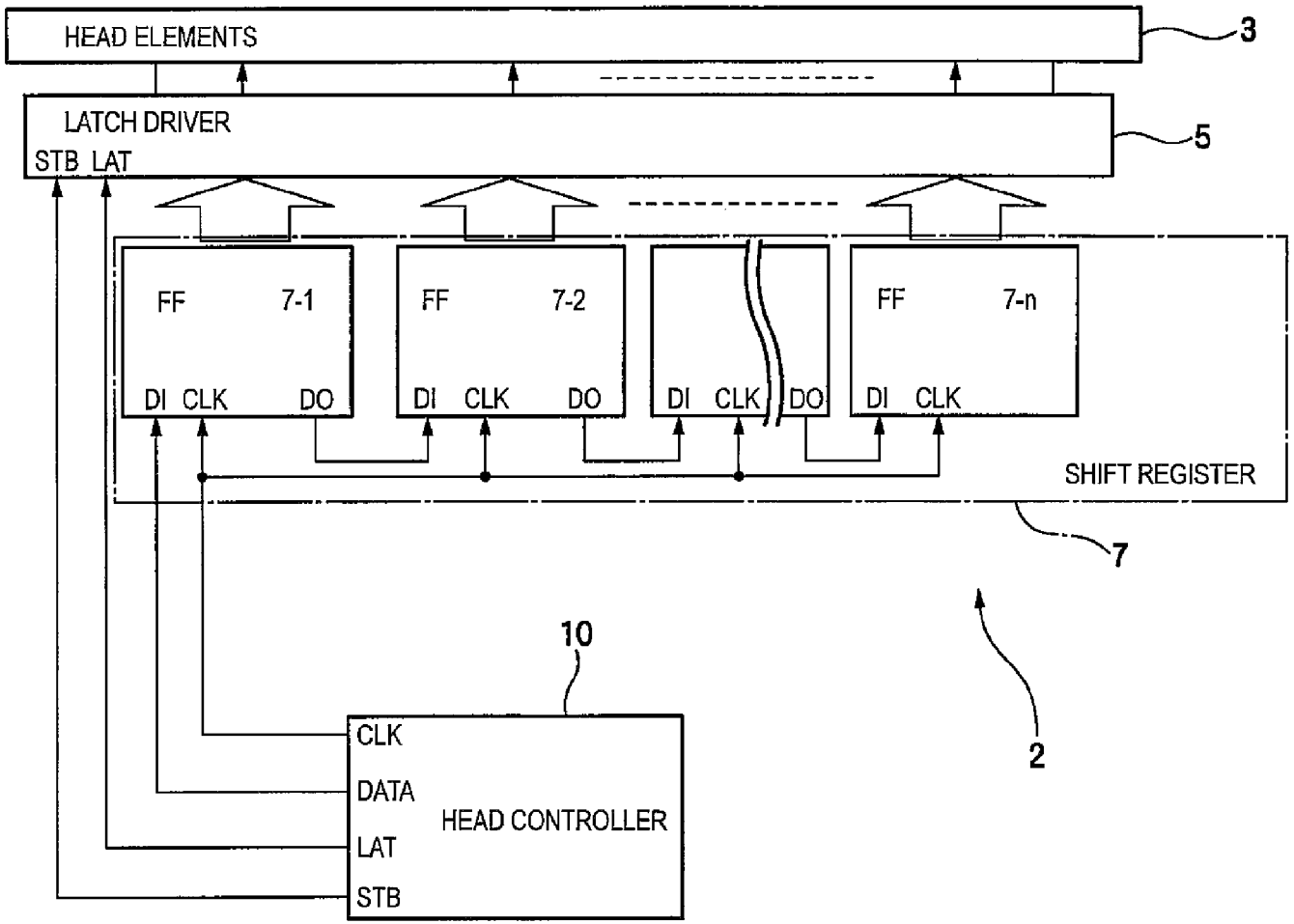
FIG. 1 is a schematic diagram illustrating a configuration of a thermal head according to an embodiment of the present invention.

FIG. 1 is a block diagram illustrating an internal configuration of a thermal head in a thermal printer according to the embodiment of the present invention.

In FIG. 1, a thermal head 2 includes head elements 3 which form a head, a latch driver 5 (selector), and a shift register 7 (selector) including FFs (flip flop) of n stages. In the shift register 7, DO (Data Out) of a first stage shift register 7-1 is connected to DI (Data In) of a second stage shift register 7-2. DO of the second stage shift register 7-2 is connected to DI of a third stage shift register 7-3. Sequentially, DO of an (n-1)-th stage shift register 7-(n-1) is connected to DI of an n-th stage shift register 7-*n*.

The latch driver 5 includes an input terminal STB of a strobe signal and an input terminal LAT of a latch signal. Further, the respective shift registers 7-1 to 7-*n*, include the input terminal DI to which serial data which is printing data is input, an input terminal CLK of a clock signal, and an output terminal DO from which the serial data which overflows from the shift register 7 is output.

Serial data corresponding to one line is input by one bit according to the clock signal from the input terminal DI of the first stage shift register 7-1 according to a control signal from a head controller 10 in a main body of the thermal printer. Then, at the time when the serial data corresponding to one line is stored in the shift register 7, the serial data corresponding to one line is stored in the latch driver 5 according to the latch signal as parallel data Next, the latch driver 5 which receives the strobe signal supplies electric current to the head elements 3 corresponding to latched data of "1", while receiving the strobe signal. According to the electric current supply, an image corresponding to one line (one dot) is formed on a roll paper or the like, which is a recording medium, and then paper feeding corresponding to one dot is carried out by a paper feeding mechanism (not shown). Printing is perfoinied by repeating such a procedure.

Printing using a normal thermal printer is performed according to the above-described procedure. If any one of a plurality of head elements malfunctions, the defective head element is not able to perform a normal printing. The malfunction state of the head element includes opening and shortcircuiting of the element. In the opened state, a white bar is inserted in the printing result, and in the short-circuited state, a black bar is inserted in the printing result.

A good printing result cannot be achieved in either case. If the bars are inserted in the printing result in a barcode printing in particular, a data reading error occurs. If the position of the defective element can be determined, it is possible to perform the barcode printing according to normal element portions, avoiding the position of the defective element. Thus, it is effective to determine the position of the defective element.

[Head Element Operation Check Mechanism in Thermal Printer]

Next, a head element operation check mechanism will be described.

The head element operation check mechanism for detecting the defective elements without heating the head elements will be described with reference to FIGS. 2 to 4.

Figure 2:
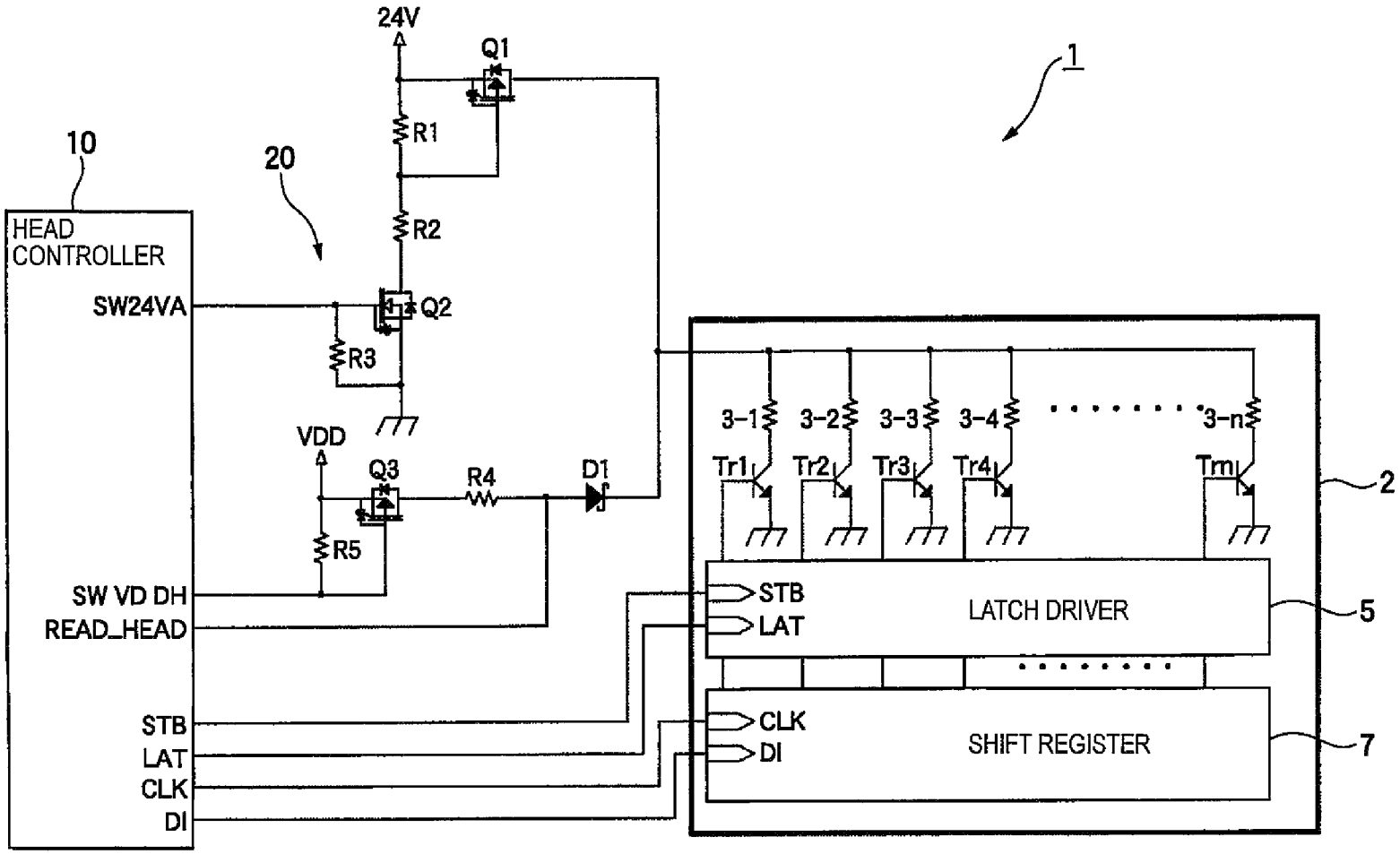
FIG. 2 is an example of a circuit diagram illustrating a head element operation check mechanism according to the embodiment.

As shown in FIG. 2, a head element operation check mechanism 1 according to the present embodiment includes a thermal head 2 and a head control circuit 20.

A plurality of head elements 3-1 to **3-*n*, (resistor elements) which include heating elements are arranged in the thermal head 2, and driving transistors Tr1 to Trn corresponding to the respective head elements 3-1 to 3-*n*, are arranged therein. The driving transistors Tr1 to Trn are switches which are selectively turned on according to a driving signal from the latch driver 5. If the driving signal is input to the driving transistors Tr1 to Trn, the respective head elements 3-1 to 3-*n*, produce heat. The driving transistors Tr1** to Trn are configured such that a driving transistor relating to data "1" in the latch data corresponding to one line is grounded to heat the head elements with voltage of 24[V].

The head control circuit 20 includes the head controller 10, and controls ON/OFF of the driving power source of 24[V] (test power source) and an operation check power source VDD of the head elements 3, according to a switch signal (SW24VA or SWVDDH). The voltage (for example, 3.3V) of the operation check power source VDD is lower than the driving voltage of 24V.

The operation check power source VDD is connected in series with the head elements 3 (with the head elements being connected in parallel) through a switching element Q3 such as an FET controlled to be turned on/off according to the switch signal (SWVDDH) from the head controller 10, a detection resistor R4 (test resistor element) and a protection diode D1. The head controller 10 controls the shift register 7, latch driver 5 and the switching element Q3 to selectively and electrically connects the head elements 3 with the detection resistor R4 in series. Further, the operation check power source VDD applies a test voltage 3.3[V] to a serial circuit between the head elements 3 and the detection resistor R4.

Further, the head controller 10 reads a voltage of a connection point between the detection resistor R4 and the head elements 3 from a READ_ HEAD terminal. That is, the head controller 10 measures a divided voltage of the serial circuit of the head elements 3 and the detection resistor R4. At this time, the head controller 10 functions as divided voltage measurement unit.

The head controller 10 stores a table which indicates the relationship between the divided voltage and the number of head elements which are electrically connected in series with the detection resistor R4. Specifically, the head controller 10 stores the table in which the horizontal axis represents the number of the turned-on head elements 3 to which electric current is applied at the same time, and the vertical axis represents divided voltages read from the READ_, HEAD terminal, as shown in FIG. 3. Here, in a case where the voltage value of the operation check power source VDD is 3.3[V], the resistance value of the detection resistor R4 is 220[Ω] and the resistance value of the thermal head 2 is 650[Ω], the divided voltage of the connection point between the detection resistor R4 and the head elements 3 is calculated as VDD×(650/m)/(220+650/m). Here, m is the number of the turned-on head elements 3.

Figure 3:
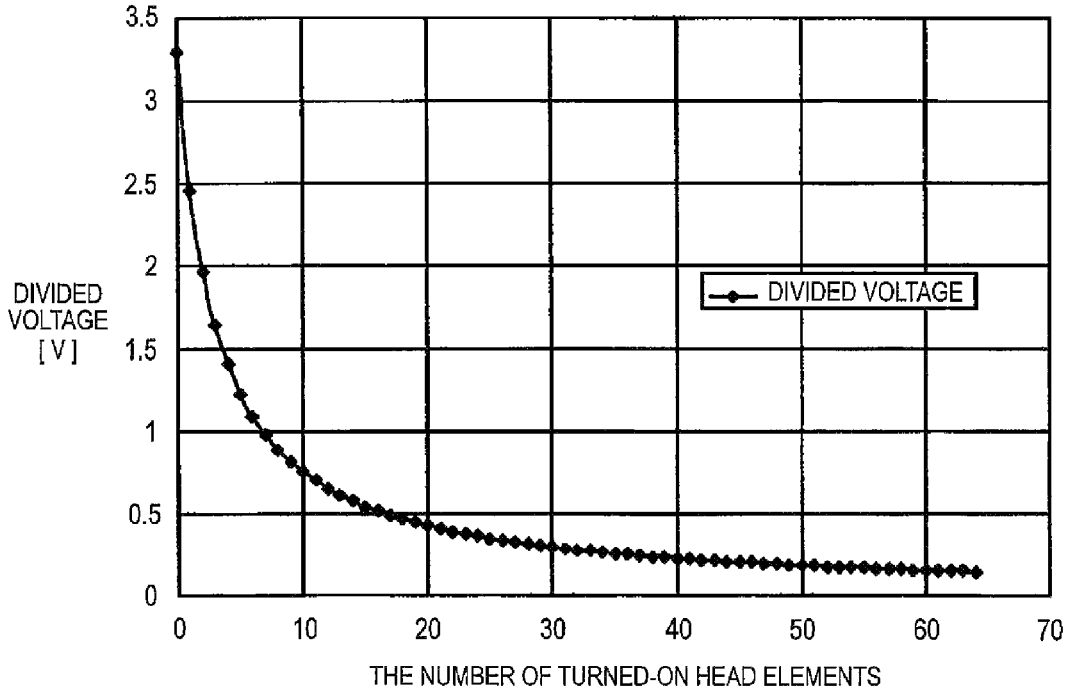
FIG. 3 is a diagram illustrating a relationship between a divided voltage and the number of turned-on head elements.

As shown in FIG. 3, when the number of the head elements which are simultaneously turned on is 0,, the divided voltage is 3.3V. As the number of the turned-on head elements increases, the divided voltage decreases. Since the level of decrease of the divided voltage is relatively large for turned-on head elements numbering between 1, to 3,, by storing the table of FIG. 3 in advance and referring to this table, the number of turned-on head elements can be determined from a detected value of the divided voltage.

[Head Element Operation Check Method in Thermal Printer]

Nest, the head element operation check method will be described.

A method of checking for a short-circuit fault of the head elements will be described with reference to a flowchart in FIG. 4.

Firstly, the head controller 10 resets the shift register 7 to set all values of the shift register 7 to 0, (step S1). Then, the operation check voltage VDD (=3.3 [, V]) is applied to detect the divided voltage (step S2). It is determined whether the divided voltage is 3.3[V] (step S3). If it is determined that the divided voltage is 3.3, [V] (step S3: Yes), it is determined that the short-circuit fault is not present in all the head elements 3, and then the procedure is terminated (step S4).

On the other hand, if the divided voltage is not 3.3[V] (step S3: No), it is determined that the short-circuit fault is present at any one of the head elements 3-1 to **3-*n*, (step S5). Next, in order to check the position of the short-circuited element, the head controller 10 inputs "1" to the input terminal DI of the shift register 7, and inputs a clock signal to the input terminal CLK (step S6). Thus, the operation check voltage is applied to the first head element 3-1**.

The head controller 10 determines whether the divided voltage of the serial circuit between the detection resistor R4 and the head element 3-1 is changed from 3.3[V] (step S7). If the divided voltage is not changed from 3.3[V] (step S7: No), it is determined that the first head element is short-circuited (step S8), and then the position of the short-circuit fault is stored. Then, the procedure goes to step S10. That is, if the divided voltage is not changed even though the number of the head elements 3 is increased by one, this means that the first head element is short-circuited. Further, it is determined whether clocks are input corresponding to the number of all the head elements 3 provided in the thermal head 2 (step S10). If the clocks corresponding to the number of all the elements are not input (step S10: No), "0" and the clock signal are input to the input terminal DI of the shift register 7 (step S11). If it is determined that the clocks corresponding to the number of all the elements are input (step S10: Yes), the procedure is terminated.

On the other hand, in step S7, if the divided voltage is changed from 3.3[V] (step S7: Yes), it is determined that the first head element is not short-circuited (step S9), and the step S10 is performed. That is, if the divided voltage is changed (decreased) by increasing the number of the head elements 3 by one, this means that the first head element is not short-circuited.

Then, if the determination in step S10 is "No", the procedure after step S7 is repeatedly performed by the number (n) of the elements, but if the determination in step S10 is "Yes", the procedure is terminated.

According to the above-described embodiment, by selectively and electrically connecting the resistor elements 3-1 to **3-*n*, of the head elements 3 in series with the detection resistor R4 and applying the operation check voltage VDD thereto, it is possible to monitor the change in the divided voltage. On the basis of the change in the divided voltage, it is possible to detect whether the respective head elements 3-1 to 3-*n*, are defective elements. Then, since the operation check power source VDD is provided differently from the driving power source of 24[V] for performing a normal printing process, if the voltage of 3.3[V] which does not heat the head elements 3 is employed in the operation check power source VDD, it is possible to detect the defective element of the thermal head in the thermal printer without heating the head element 3**.

Further, according to the embodiment, since the table indicating the relationship between the divided voltage and the number of the head elements which are electrically connected in series with the detection resistor R4 is stored in advance, it is possible to easily realize the relationship between the number of the head elements to which the operation check voltage VDD is applied and the divided voltage. In a case where one head element and the test resistor R4 are electrically connected in series and 3.3[V] is applied thereto, if the head element 3 is normal, the divided voltage is decreased. Using the change in the divided voltage, it is possible to check for malfunctions in each head element 3.

Figure 4:
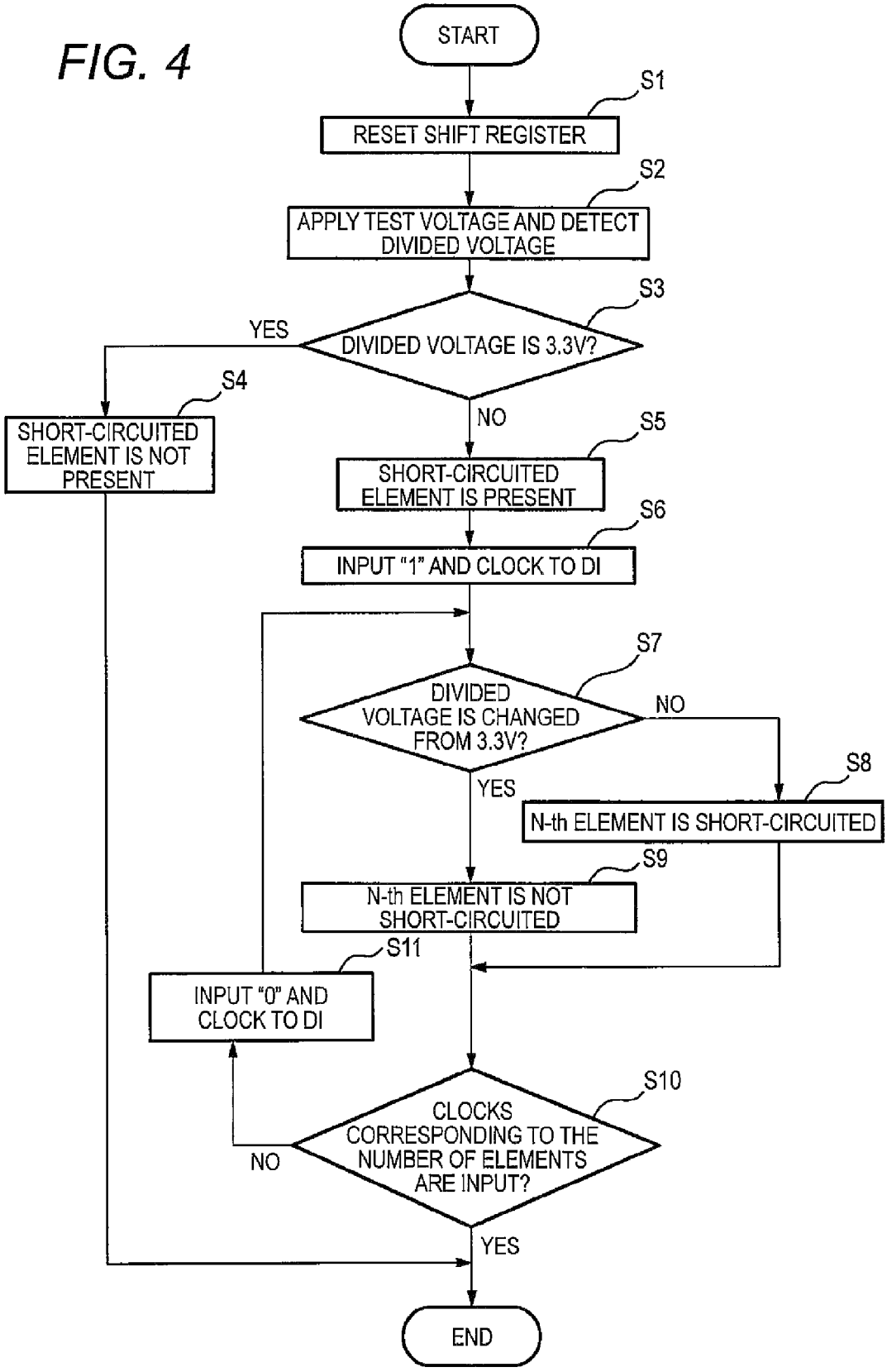
FIG. 4 is a flowchart illustrating a head element operation check method according to the embodiment.

Further, according to the embodiment, since the defective elements of the thermal printer can be automatically detected simply by adding the operation check power source VDD and the detection resistor R4 to the configuration of the related-art thermal head and performing the respective steps shown in FIG. 4, it is not necessary for a user to perform a complicated setting manipulation.

[Head Element Number Check Method in Thermal Head]

Next, a head element number check method will be described.

Figure 5:
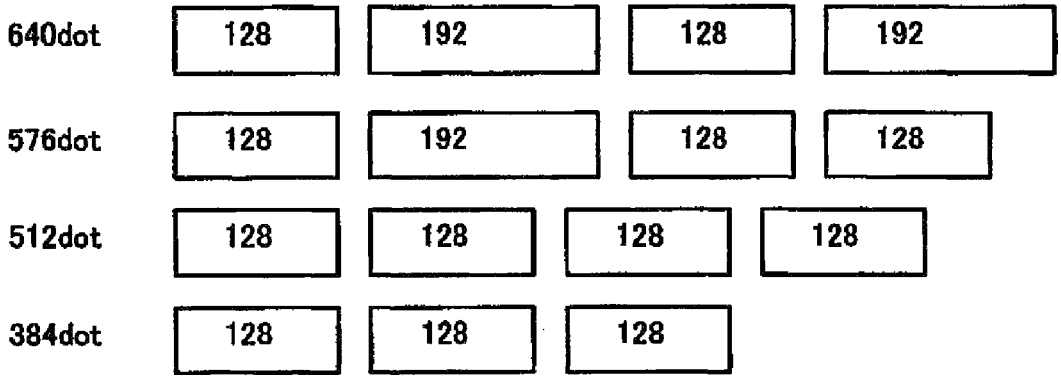
FIG. 5 is a diagram illustrating a plurality of examples of the number of head elements in a thermal head according to the embodiment.

Here, the number of the head elements does not refer to an irregular and random number, but refers to a head element number corresponding to a plurality of types which meet a predetermined standard. For example, as shown in FIG. 5, the number of the head elements is 384, 512, 576, or 640, [dots] which can be divided into units of 64, [dots]. It may be determined whether the number of the head elements is any one of these dot numbers.

Figure 6:
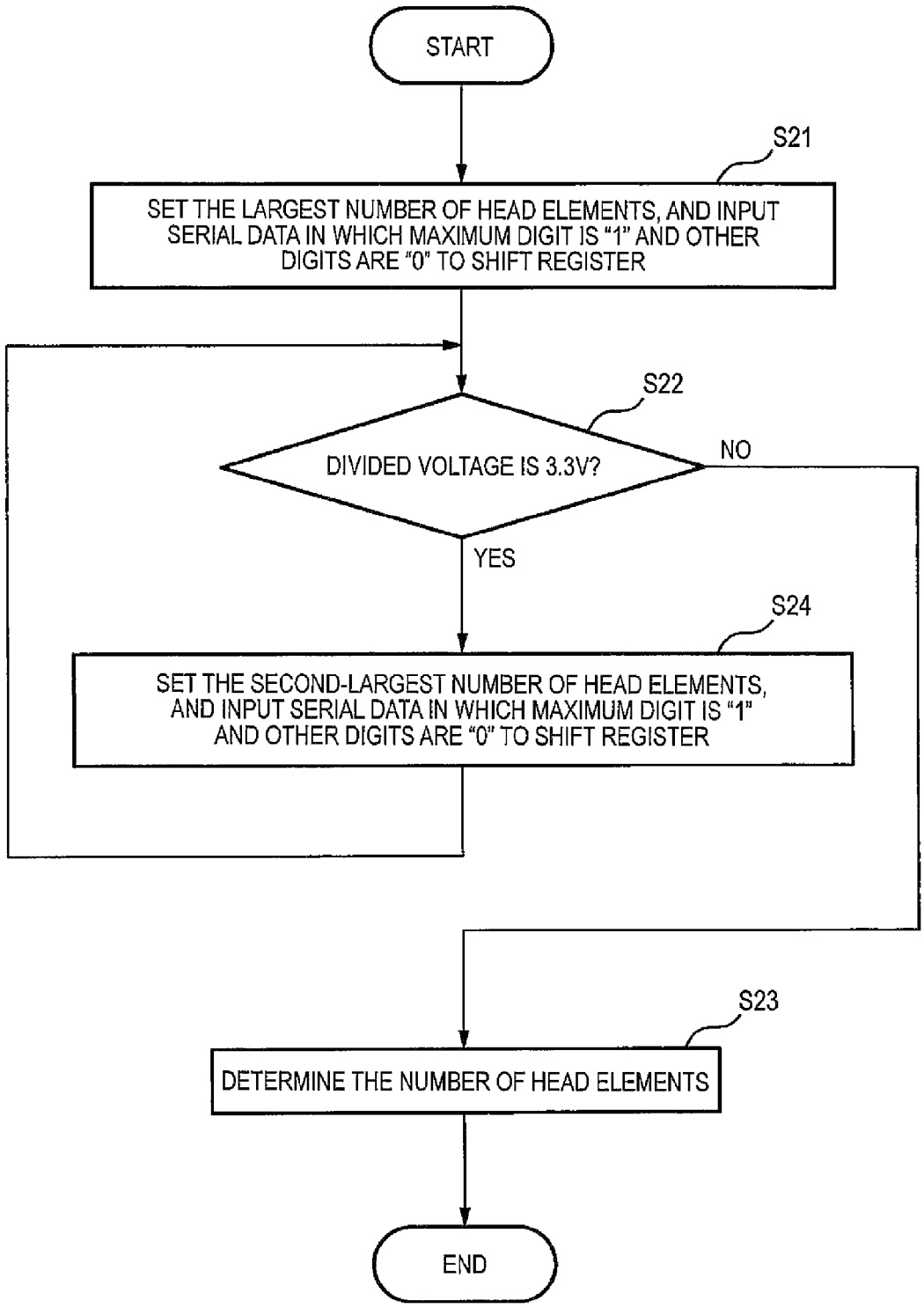
FIG. 6 is a flowchart illustrating a head element number check method in a thermal head according to the embodiment.

A method of checking the number of the head elements of the thermal head will be described with reference to a flowchart in FIG. 6.

Firstly, assuming that the number of the head elements is the largest number of 640, dots, the head controller 10 inputs serial data (element number check data) in which the maximum digit (640th dot) is "1" and the other digits (from the first dot to the 639th dot) are "0" to the input terminals DI of the shift register 7 together with the clock signal (step S21). Thereafter, it is determined whether the divided voltage of the serial circuit of the head elements 3 and the detection resistor R4 is 3.3[V] (step S22). If it is determined that the divided voltage is not 3.3[V] (step S22: No), it is determined that the number of the head elements is 640, (step S23).

If it is determined that the divided voltage is 3.3[V] (step S22: Yes), the head controller 10 assumes that the number of the head elements is the second largest number of 576, dots, and inputs serial data (element number check data) in which the maximum digit (576th dot) is "1" and the other digits (from the first dot to the 575th dot) are "0" to the input terminals DI of the shift register 7 together with the clock signal (step S24). Thereafter, it is again determined whether the divided voltage is 3.3[V] (step S22). If it is determined that the divided voltage is not 3.3[V] (step S22: No), it is determined that the number of the head elements is 576, dots (step S23).

If it is determined that the divided voltage is 3.3[V] (step S22: No), the head controller 10 assumes that the number of the head elements is the next largest number of 512, dots, and inputs serial data (element number check data) in which the maximum digit (512th dot) is "1" and the other digits (from the first dot to the 511th dot) are "0" to the input terminals DI of the shift register 7 together with the clock signal (step S24). Thereafter, it is again determined whether the divided voltage is 3.3[V] (step S22). If the divided voltage is not 3.3[V] (step S22: No), it is determined that the number of the head elements is 512, dots (step S23).

If it is determined that the divided voltage is 3.3, [V] (step S22: Yes), the head controller 10 assumes that the number of the head elements is the next largest number (the smallest number) of 384, dots, and inputs serial data (element number check data) in which the maximum digit (384th dot) is "1" and the other digits (from the first dot to the 383th dot) are "0" to the input terminals DI of the shift register 7 together with the clock signal (step S24). Thereafter, it is again determined whether the divided voltage is 3.3[V] (step S22). If it is determined that the divided voltage is not 3.3[V] (step S22: Yes), it is determined that the number of the head elements is 384, dots (step S23).

The head element number check method according to the embodiment inputs the element number check data to the shift register 7 as printing data corresponding to one line, detects the divided voltage, and then checks the number of the head elements on the basis of a result of this detection. The element number check data which is first input has a digit number corresponding to the largest number of the head elements (640, dots in the embodiment) in a predetermined standard, the maximum digit thereof being 1, and the other digits thereof being 0.

If the number of the head elements is not determined with the first input element number check data, another element number check data is input to the shift register 7. The element number check data which is secondly input has the digit number corresponding to the second-largest number of the head elements (576, dots) in the predetermined standard, the maximum digit thereof being 1, and the other digits thereof being 0. Thereafter, the divided voltage is again detected and the number of the head elements is checked on the basis of a result of this detection. Until the number of the head elements is determined, the above method is repeated while gradually reducing the digit number of the element number check data in conformity to the predetermined standard.

In the embodiment, only the maximum digit of the element number check data is 1, and the other digits are 0. However, at least one digit from the first digit (i.e. the maximum digit) of the element number check data may be 1.

In this way, according to the embodiment, it is possible to automatically detect the number of the head elements 3, in addition to detection of the defective elements of the thermal printer. In the embodiment, the element number check data having a digit number corresponding to the element number in a predetermined standard, at least one digit from the first digit thereof being 1, and the other digits thereof being 0, is input to the shift register 7 and the change in the divided voltage at the time of applying the operation check voltage VDD is detected. If the divided voltage is changed, it is found that the operation check voltage VDD is applied to the head element to which data "1" is input. Thus, it is possible to determine that the number of the head elements is at least equal to or higher than the digit number of the input serial data of one line. On the other hand, if the divided voltage is not changed, it is possible to determine that the number of the head element is less than the digit number of the input serial data of one line. Thus, if the divided voltage is not changed, the digit number of the element number check data is sequentially reduced such as 576, dots, 512, dots, and 364, dots, and the digit number when the divided voltage is changed is detected as the number of the head elements. In this way, with the head element number check method according to the embodiment, it is possible to easily check the number of head elements.

The present invention is not necessarily limited to the embodiments. For example, head elements including resister elements, other than the thermal head elements including heating elements may be used in the head element operation check mechanism. A selector other than the shift register and the larch circuit may be used in the head element operation check mechanism. In the embodiment, the present invention is applied to the thermal printer including the thermal head. The present invention may also be applied to the other printer such as an ink jet printer or a laser printer.

What is claimed is:

1. A head element number check method in a printer which includes a head including a plurality of head elements, a latch circuit and a shift register for inputting printing data corresponding to one line to the head through the latch circuit and performs printing with using the head elements, the head element number check method comprising:

inputting element number check data to the shift register as the printing data corresponding to one line;

detecting a divided voltage of a serial circuit of a test resistor element and a resistor element provided in each of the head elements while inputting the element number check data to the shift register; and checking the number of the head elements on the basis of a result of the detecting, wherein checking the number of the head elements includes determining a total number of the head elements on the basis of the detected divided voltage.

2. The head element number check method as set forth in claim 1, wherein the element number check data has a digit number corresponding to the first number of the head elements in a predetermined standard, at least one digit from the first digit thereof being 1, and the other digits thereof being 0.

3. The head element number check method as set forth in claim 2, further comprising:

if the number of the head elements is not determined in the checking, inputting element number check data which has a digit number corresponding to the second number of the head elements, less than the first number in the predetermined standard, at least one digit from the first digit thereof being 1, and the other digits thereof being 0, to the shift register as the printing data corresponding to one line; and performing the detecting and the checking again.

4. The head element number check method as set forth in claim 3, further comprising repeating the steps of claim 3 while gradually reducing the digit number of the element number check data in conformity with the predetermined standard until the number of the head elements is determined in the checking.

5. The head element number check method as set forth in claim 4, wherein:

the first number of the head elements is a largest number of the head elements;

the second number of the head elements is a second largest number of the head elements; and gradually reducing the digit number includes reducing the digit number to successively next largest numbers of the head elements.

6. The head element number check method as set forth in claim 2, wherein the first number of the head elements is a largest number of the head elements.

7. The head element number check method as set forth in claim 3, wherein:

the first number of the head elements is a largest number of the head elements; and the second number of the head elements is a second largest number of the head elements.

* * * * *